US006082897A

United States Patent [19]

Galomb

[11] Patent Number: 6,082,897

[45] Date of Patent: Jul. 4, 2000

[54] SEGMENTED SNAP CLOSURE FOR FLEXIBLE PACKAGES AND FLEXIBLE PACKAGES INCLUDING THE SAME

[75] Inventor: David E. Galomb, Allentown, Pa.

[73] Assignee: Fres-co System USA, Inc., Telford, Pa.

[21] Appl. No.: 09/305,409

[22] Filed: May 5, 1999

Related U.S. Application Data

[63] Continuation-in-part of application No. 09/231,337, Jan. 13, 1999.

[51] Int. Cl.[7] ..... B65D 33/16

[52] U.S. Cl. ..... 383/63; 383/65; 383/68; 24/587

[58] Field of Search ..... 383/63, 64, 65, 383/68; 24/587

[56] References Cited

U.S. PATENT DOCUMENTS

| | | | |
|---|---|---|---|
| D. 350,696 | 9/1994 | Naslund . | |
| 3,557,413 | 1/1971 | Engle | 24/587 |
| 4,576,285 | 3/1986 | Goglio . | |
| 4,703,518 | 10/1987 | Ausnit | 383/63 |
| 4,705,174 | 11/1987 | Goglio . | |
| 4,756,628 | 7/1988 | Branson | 383/63 |
| 4,787,754 | 11/1988 | Herrington | 383/63 |
| 4,787,755 | 11/1988 | Branson | 383/68 X |
| 4,807,300 | 2/1989 | Ausnit et al. | 383/63 |
| 4,907,321 | 3/1990 | Williams | 383/63 X |
| 4,913,561 | 4/1990 | Beer . | |
| 4,944,072 | 7/1990 | Robson | 383/65 X |
| 4,988,216 | 1/1991 | Lyman . | |
| 5,037,138 | 8/1991 | McClintock et al. . | |
| 5,059,036 | 10/1991 | Richison et al. . | |
| 5,147,272 | 9/1992 | Richison et al. . | |
| 5,403,094 | 4/1995 | Tomic | 383/63 |
| 5,622,431 | 4/1997 | Simonsen | 383/68 X |
| 5,692,837 | 12/1997 | Beer . | |
| 5,722,128 | 3/1998 | Toney et al. | 24/587 X |
| 5,738,444 | 4/1998 | Lantz et al. . | |
| 5,934,806 | 8/1999 | Tomic et al. | 383/63 |

FOREIGN PATENT DOCUMENTS

| | | |
|---|---|---|
| 6127557 | 5/1994 | Japan . |
| 1008068 | 10/1965 | United Kingdom . |

OTHER PUBLICATIONS

"Champ Insulated Propac II", packaging including ice bag and fastener (photocopy of the product's label and photograph of the fastener part of the product) of Carolon Company of Rural Hal, NC, No Date.

"CLIP–it" fastener of Weland M. AB, a Swedish Corporation (two photographs of the fastener), No date.

*Primary Examiner*—Jes F. Pascua

*Attorney, Agent, or Firm*—Caesar, Rivise, Bernstein, Cohen & Pokotilow, Ltd.

[57] ABSTRACT

A snap closure for a flexible, gusseted package and a flexible gusseted packing including the closure. The package includes a mouth portion arranged to be opened to provide access to the contents of the package. The package is formed of a flexible material and includes a front panel, a rear panel, and a pair of opposed side gussets. The panels and gussets each include a top portion, which between them define the package's mouth. The package's mouth is initially sealed but arranged to be opened, e.g., peeled apart. The snap closure enables the resealing of the mouth of the package and is made up of a pair of elongated elements, one of which includes a tongue extending along the length of it. The other element includes an undercut groove extending along the length of it. The elements are arranged to be pressed together, whereupon the tongue of the one element enters the groove of the other element with portions of the panels and side gussets tightly interposed therebetween. The closure elements may be longitudinally rigid or may be segmented to flex in the longitudinal direction to facilitate opening. Moreover, the closure elements may be a part of the package or separate components for use therewith. In any case when the closure is utilized it recloses the mouth of the package to preclude or minimize the ingress of air into the package.

18 Claims, 8 Drawing Sheets

FIG.1
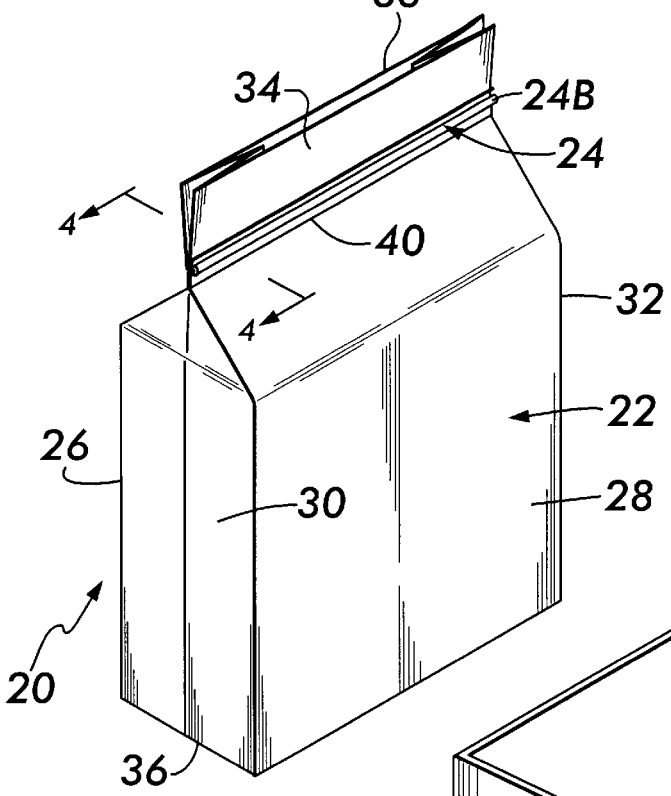
FIG.2
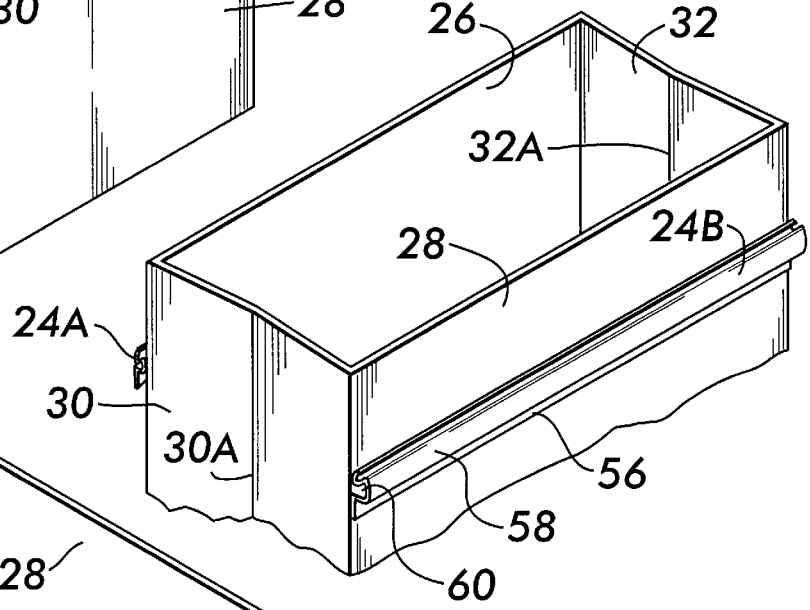
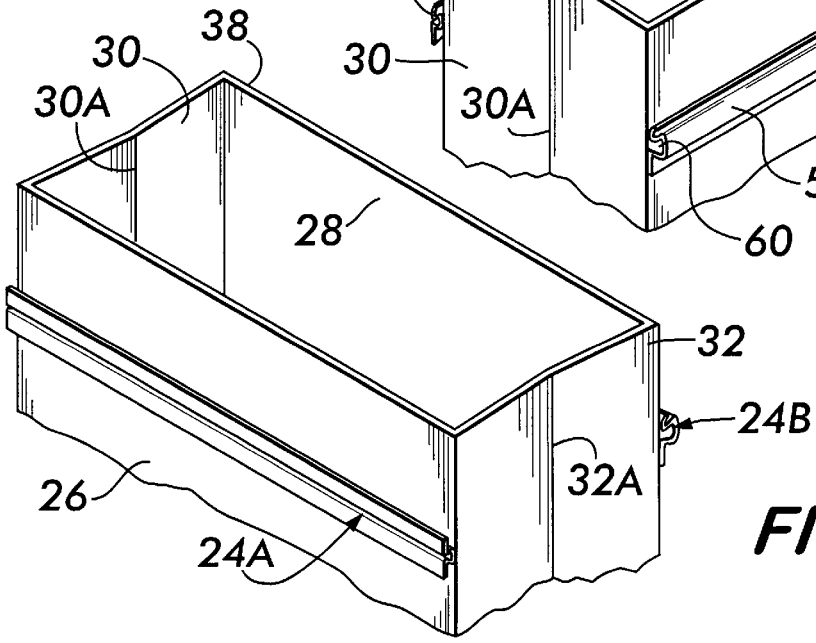
FIG.3

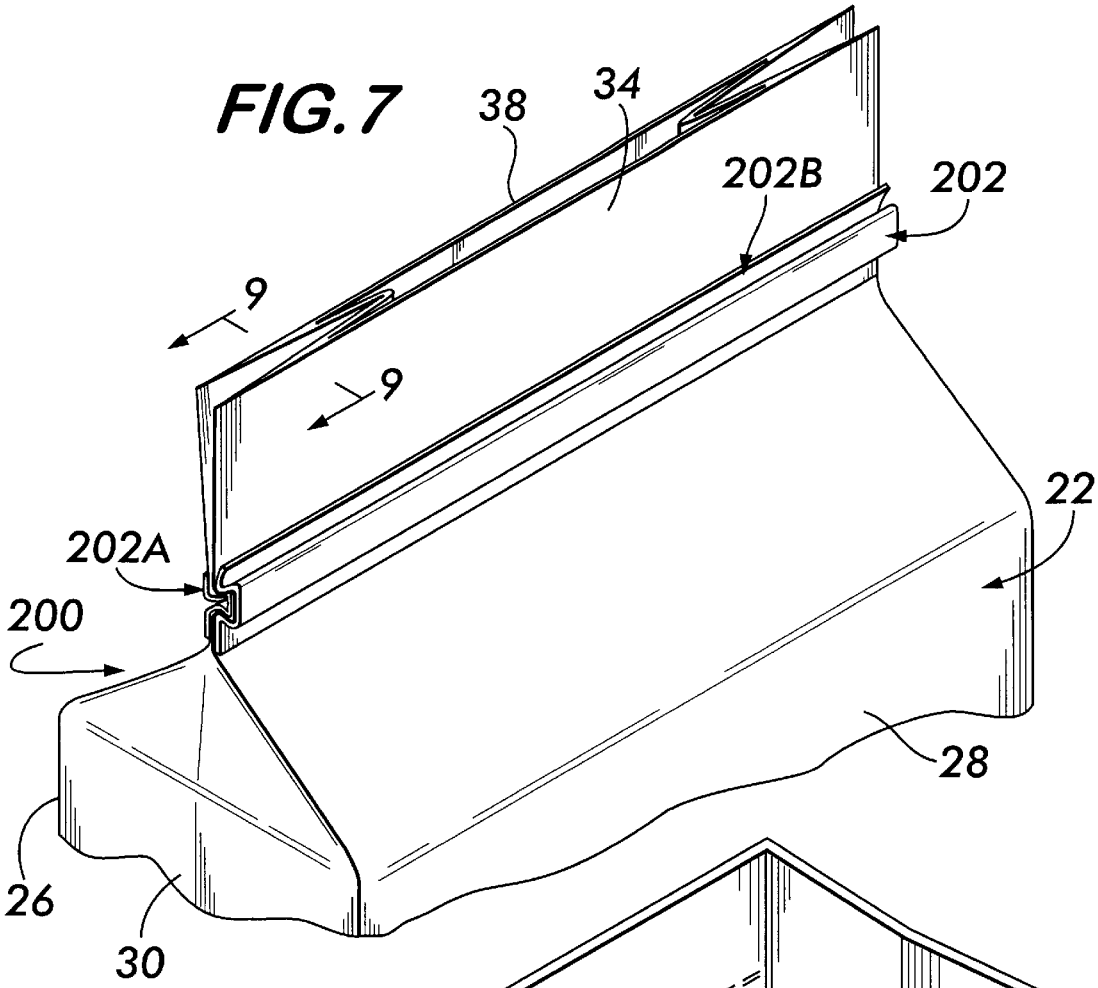
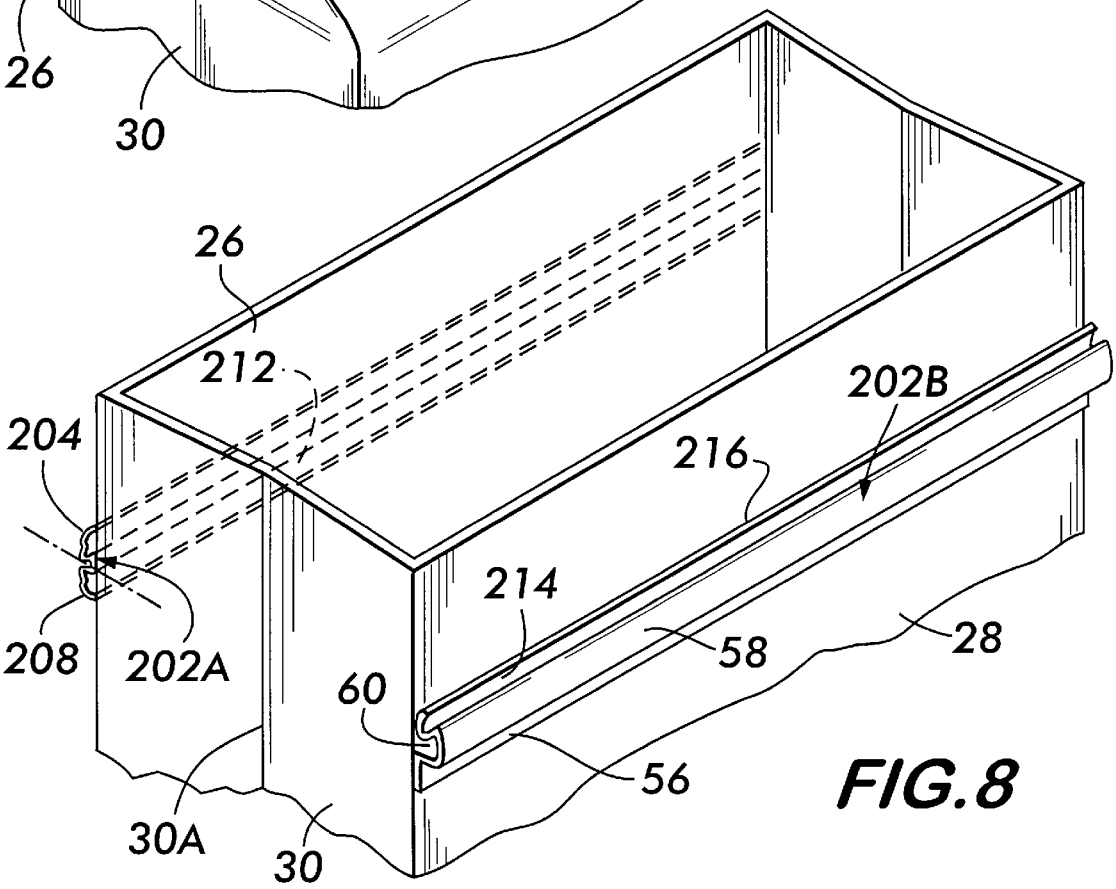
FIG. 8

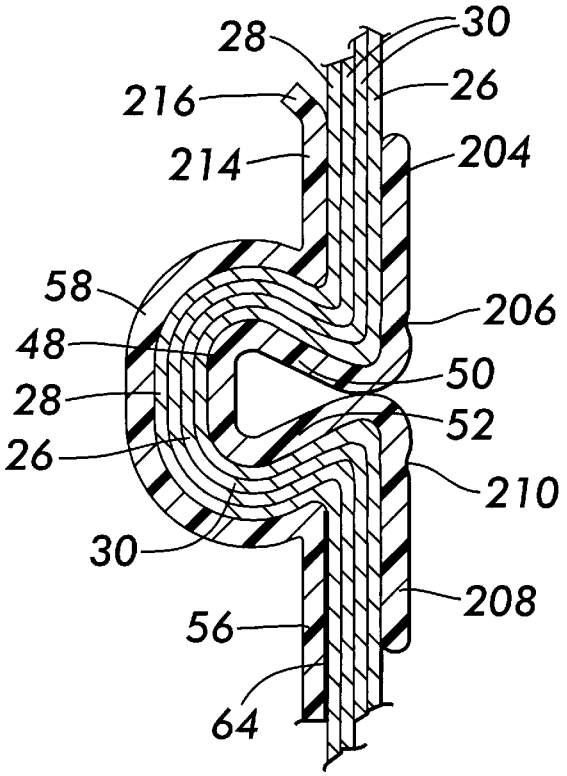
FIG.9
FIG.10
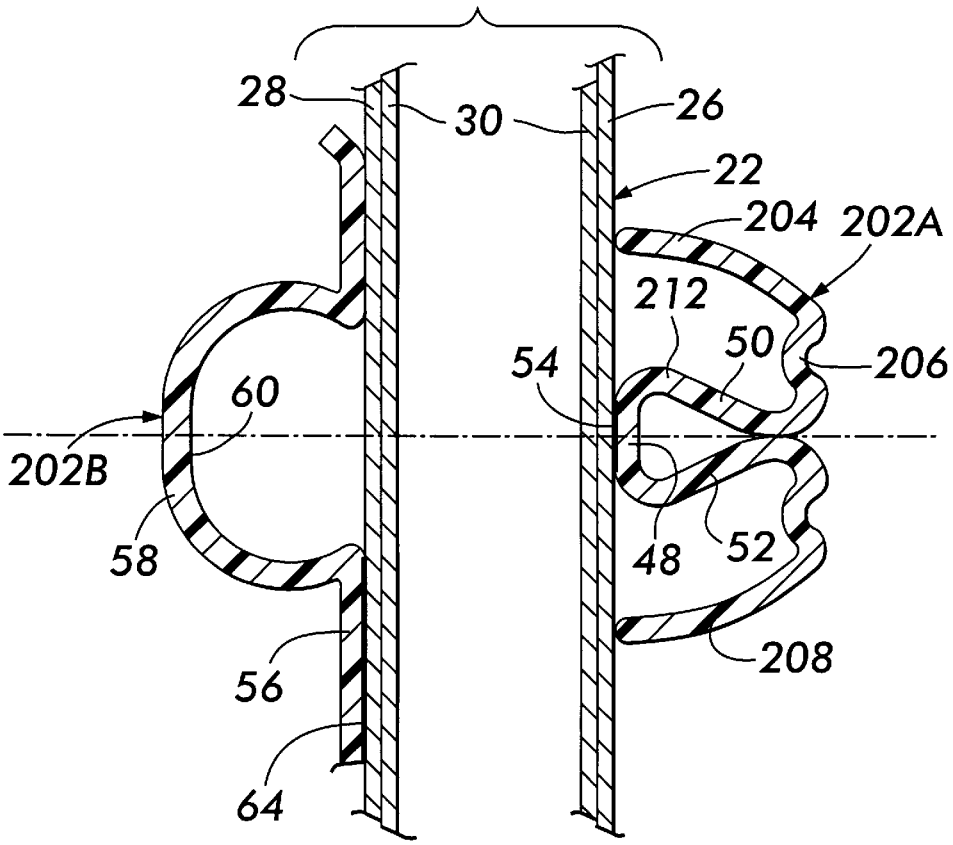

400
402A
204
206
210
408
410
404A
406A
406A
406A
208
408
26
410
50
52
212
48
54
410
408
30
28
214
216
60
412
414
56
64
58
406B
406B
402B

SEGMENTED SNAP CLOSURE FOR FLEXIBLE PACKAGES AND FLEXIBLE PACKAGES INCLUDING THE SAME

RELATED APPLICATION

This application is a Continuation-In-Part of copending U.S. patent application Ser. No. 09/231,337, filed on Jan. 13, 1999, entitled Snap Closure for Flexible Packages and Flexible Packages Including the Same, which is assigned to the same assignee as this invention and whose disclosure is incorporated by reference herein.

BACKGROUND OF THE INVENTION

This invention relates generally to flexible packages, and more particularly to flexible packages for holding products, such as foods, under vacuum therein, and which once opened are arranged to be repeatedly re-opened and re-closed, while keeping the contents fresh.

Various types of flexible packages for holding particulate materials, e.g., ground or whole bean coffee, chemicals, etc., under vacuum therein have been disclosed in the patent literature and are commercially available today. Examples of such packages are found in the following U.S. Pat. Nos.: 4,576,285 (Goglio), 4,705,174 (Goglio), and 4,913,561 (Beer).

The major advantages of flexible packaging, as compared to relatively rigid packaging, e.g., cartons, are that until the flexible package is filled it takes up very little volume, and after it is emptied of its contents it readily collapses, thereby reducing its volume to approximately that of the unfilled package. The former characteristic is a significant advantage insofar as storage is concerned, while the latter characteristic is a significant advantage from the standpoint of being disposable.

One common type of flexible package for holding goods under vacuum until the package is opened is the so-called "gusseted" package or bag. Typically such a package is formed from a web of flexible stock material, e.g., polyethylene, polyester, polypropylene, metal foil, and combinations thereof in single or multiple plies, into a tubular body, having a face panel, a back panel, and a pair of gusseted sides. Each gusseted side is formed by a pair of gusset sections and a central fold edge interposed between a pair of outer fold edges. The lower end of the bag is commonly permanently sealed, e.g., heat sealed, along a line extending transversely across the width of the bag close to its bottom edge. The top of the bag is commonly sealed transversely across the entire width of the bag in a number of ways to maintain the contents under vacuum until the bag is opened. Such action is frequently accomplished via a readily openable mouth, which when opened provides access to the contents of the bag. For example, in one prior art package the top seal is made peelable by modifying the sealant layer with a peelable coating or incompatible additive. Thus, when the seal is peeled apart the unsealed portions form an open mouth through which the contents of the package may be removed. Another approach to providing an opening or mouth for a flexible package is that of the heretofore identified U.S. Pat. No. 4,705,174 (Goglio). That package includes a peel strip applied to the inner surface of the package below the top edges. The strip provides an air-tight interfacial seal which can be readily peeled apart to provide access to the interior of the package. Another approach to providing an opening or mouth for a flexible package is to score the upper flap of the package by laser or mechanical means through a tear initiation resistant layer(s) of the package structure. In this way the package can be opened by tearing away the scored area to form the package's mouth.

Gusseted bags, particularly those for foods, frequently make use of a plastic coated wire tie to serve as closure for the bag. In particular, the wire tie is designed to close the mouth of the bag after it has been initially opened so that the re-closed bag will keep its contents fresh. Whether or not such wire-tie closures effectively provide a positive means of re-closing a gusseted package is open to debate. Moreover, the effectiveness of such closures is frequently dependent upon the manner in which the wire tie is used. Thus, there is a perception in some quarters of the consuming public that a wire-tie package cannot be re-closed securely enough to maintain product freshness over an extended period of time. Therefore, such packages have not been fully accepted as being truly reclosable.

Non-gusseted flexible packages, such as stand-up pouches, are commercially available and typically include so-called "zipper-type" closures. Examples, of such packages are shown in U.S. Pat. Nos. 5,059,036 (Richison et al.), and 5,147,272 (Richison et al.). These zipper-type closures are generally perceived by the consuming public as providing for a more effective reclosure of the flexible pouch after it has been initially opened than twist or wire tie closures. In fact, zipper-type closures may be more effective than wire-tie closures. At the very least they are easier to use, and not prone to loss or misplacement. Thus, stand-up, flexible pouches with zipper-type closures have gained wide acceptance by the consumer.

While the stand-up, zipper-closure type pouch offers advantages over a gusseted flexible package insofar as actual or perceived reclosability is concerned, its shape does not allow efficient use of case packing and retail shelf space, as does a gusseted package. In addition, the stand-up pouch cannot be stacked readily, if at all.

In U.S. Pat. No. 5,692,837 (Beer), which is assigned to the same assignee as this invention and whose disclosure is incorporated by reference herein there is disclosed a gusseted flexible package having a integrated snap closure for re-closing and resealing the package after it has been initially opened. In particular, that package has an interior for initially holding some product, e.g., whole coffee bean or ground coffee, under vacuum, and which includes a mouth portion arranged to be peeled open to provide access to the contents of the package. The package is formed of a flexible material and includes a front panel, a rear panel, and a pair of opposed side gussets. The panels and gussets each include a top portion, which between them define the package's mouth. A peelable closure is provided within the mouth. A snap closure is provided above the peelable closure. The package is arranged to be sealed under vacuum, with the peelable closure maintaining the vacuum within the package until it is peeled open. The snap closure comprises a pair of snap strip members secured to respective portions of the front and rear panel. The snap strip portions are arranged to be releasably snap fit together with portions of the closure extending through opening in the side gussets, so that the snap strip portions can be opened and re-closed after the peelable closure has been peeled open in order to provide repeated access to the interior of the package, while minimizing the ingress of air into the package when it is closed.

Other references involving closures for packages are found in U.S. Pat. Nos.: 4,988,216 (Lyman), and 5,037,138 (McClintock et al.), and in Japanese Application 6127557 (May 1994), and United Kingdom Patent 1,008,068 (October 1965)

While the inventions of the aforementioned prior art are suitable for their intended purposes, a need still exists for snap closures for use on gusseted packages and for gusseted packages which include snap closures not requiring holes or openings in the gussets of the package to effect reclosure of the package.

OBJECTS OF THE INVENTION

Accordingly, it is a general object of this invention to provide another gusseted flexible package which addresses the needs of the prior art.

It is a further object of this invention to provide a gusseted flexible package which includes a snap closure.

It is a further object of this invention to provide a gusseted flexible package with a snap closure which is simple in construction.

It is a further object of this invention to provide a gusseted flexible package which includes a snap closure and which is low in cost.

It is a further object of this invention to provide a gusseted flexible package which includes a snap closure and which can be manufactured easily.

It is a further object of this invention to provide a gusseted flexible package which includes snap closure and which is easy to use.

It is a further object of this invention to provide a gusseted flexible package which includes a snap closure that does not require openings in the gussets in order to operate to seal the package.

SUMMARY OF THE INVENTION

These and other objects of the instant invention are achieved by providing snap closure and a flexible, gusseted package including a snap closure. The package has an interior for holding some material, e.g., whole bean coffee, ground coffee, etc., therein. The package is formed of a flexible material and comprises first and second panels connected to each other by respective side gussets. Each of the panels and said gussets has an upper end portion which conjoin to form a mouth for the package. The mouth is openable to provide access to the interior of the package.

The snap closure is arranged for re-closing and sealing the package's mouth and comprises a first closure element and second closure element. The first closure element is located on the first panel adjacent the package's mouth. The second closure element is located on the second panel adjacent the package's mouth.

The first closure element is an elongated, segmented member having a longitudinal axis extending substantially the width of the first panel and a having a tongue extending substantially the width thereof. The second closure element is also an elongated, segmented member having a longitudinal axis extending substantially the width of said second panel and parallel to said longitudinal axis of said first element. The second closure element includes an undercut groove extending substantially the width thereof. The tongue of said first closure element is arranged to be snap-fit into the undercut groove of the second connector member with portions of the package's panels tightly interposed therebetween to close the mouth of package to prevent the ingress of air into the package through its mouth.

The segments, e.g., short sections of the respective closure elements formed between immediately adjacent transversely extending slits, are flexibly connected to each other. This arrangement enables each closure element to flex with respect to its longitudinal axis so that the user of the package can readily insert his/her fingers between the two closure elements when they are secured together to pull them apart to open the package's mouth.

DESCRIPTION OF THE DRAWING

FIG. 1 is an isometric view of one embodiment of a flexible gusseted package including a closure, the package being constructed in accordance with this invention and being shown in the state prior to being initially opened;

FIG. 2 is an enlarged isometric view taken from one side of the embodiment of the package of FIG. 1 showing the package after it has been initially opened to provide access to its interior;

FIG. 3 is enlarged isometric similar to FIG. 2, but taken from the opposite side of the package;

FIG. 7 is an isometric view of another embodiment of a flexible gusseted package including a closure, the package being constructed in accordance with this invention and being shown in the state prior to being initially opened;

FIG. 8 is an enlarged isometric view taken from one side of the embodiment of the package of FIG. 7 showing the package after it has been initially opened to provide access to its interior;

FIG. 9 is an enlarged sectional view taken along line 9—9 of FIG. 7;

FIG. 10 is an enlarged sectional view similar to that of FIG. 9, but showing the package in the process of being resealed or re-closed using the package's closure;

DETAILED DESCRIPTION OF THE PREFERRED EMBODIMENT

Figure 4:
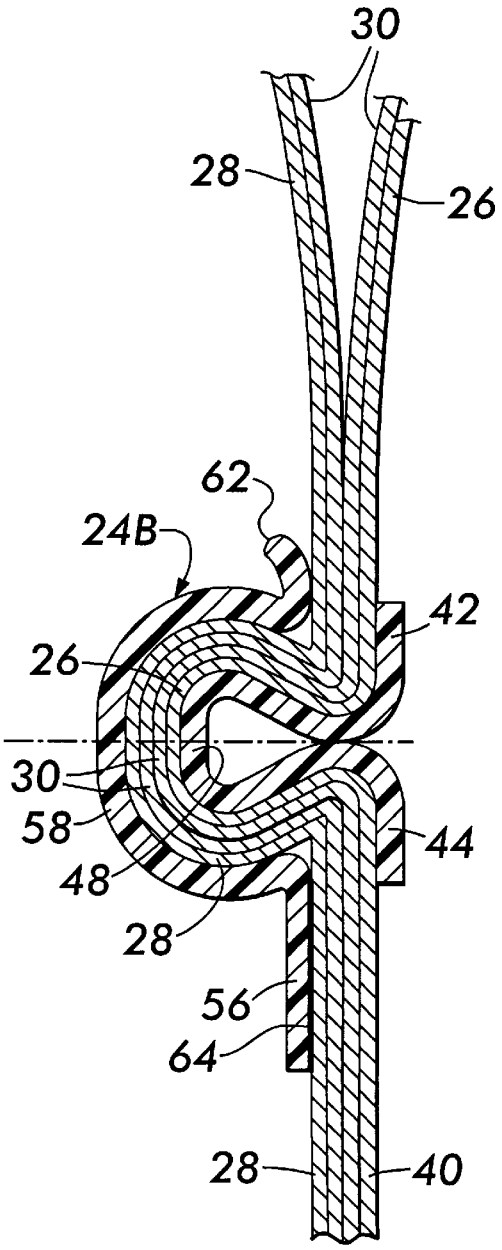
FIG. 4 is an enlarged sectional view taken along line 4—4 of FIG. 1.

Referring to FIG. 1, there is shown at 20 in FIG. 1 a flexible package constructed in accordance with this invention. The package 20 basically comprises a gusseted bag 22 and a resealable closure 24. The bag 20 is arranged to hold any material, e.g., coffee beans, ground coffee, chemicals, etc., for dispensing therefrom. The bag or package 22 is formed of a web of any suitable, flexible material in a manner to be described hereinafter.

Turning now to FIGS. 1–3 it can be seen that package 22 basically comprises a front wall or panel 26, a rear wall or panel 28, a pair of identical gusseted sides 30 and 32, a top end portion 34, and a bottom end portion 36. The top end portion 34 of the package terminates in a top marginal edge 38. In a similar manner the bottom end portion 36 in a bottom marginal edge (not shown). If desired, an a one-way venting valve (not shown) may be included in any suitable portion of the package to enable gases which may be produced by the material(s), e.g., coffee, contained within the sealed package to vent to the ambient air without air gaining ingress to the package's interior.

The front panel 26, rear panel 28, and the two gusseted sides 30 and 32 of the package are all integral portions of a single sheet or web of the flexible material, of single or multiple ply or layers, which has been folded and seamed to form a tubular body. One particularly useful flexible material for the package 22 is a laminated web of flexible packaging material commercially available from Fres-Co System USA, Inc., of Telford Pa., the assignee of this invention. That material comprises a 48 gauge polyester layer, ink, an adhesive layer, a 28 gauge aluminum foil layer, another adhesive layer, a 60 gauge nylon layer, another adhesive layer, and a 300 gauge easy open sealant layer. When a web of such material is formed into the tubular body for the package the polyester layer serves as the outer surface of the package, with the easy-open sealant layer being the inner surface of the package.

As can be seen clearly in FIGS. 1–4, the closure 24 is located in the top end portion 34 of the package. The details of the closure 24 will be described later. Suffice it for now to state that the closure 24 includes two strips 24A and 24B which extends across the width of the package's panels 24 and 26, with portions secured on the outer surface thereof in the top portion of the package below its top edge 38.

The package 20 is arranged to be initially hermetically sealed closed along a transverse seal line 40, after it has been filled and vacuumized. The seal line 40 may be permanent or openable (e.g., peelable) and may be formed in any conventional manner. If the seal line is peelable it may be located at any location either above, below, or aligned with the closure 24. In such an embodiment the package can be readily opened by merely grasping the top edges of the front and rear panels and pulling them apart to cause the peelable seal line to open, thereby forming a mouth for the package to provide access to the interior of the package. If the seal line is permanent it should be located above the closure 22 with some space between it an the closure so that the package can be severed along a line between the seal line and the closure to thereby form the package's mouth. In either case, the seal line 40 extends across the width of the package 22 and seals the inner surfaces of the abutting front and rear panels to each other between the inner fold lines 30A and 32A of the gussets 30 and 32, respectively, while sealing the outer marginal portions of the front panel 26 to the portions of the gusseted sides contiguous therewith, while also sealing the outer marginal portions of the rear panel 28 to the portions of the gusseted sides contiguous therewith, as is conventional. Thus, the seal line 40 serves to isolate the contents of the package from the ambient atmosphere once it is sealed. If the seal line 40 is peelable, it may be formed by the appropriate heat sealing of the abutting easy-open sealant layer portions forming the inner surface of the package 22. Alternatively, a peelable seal line 40 can be formed in any other conventional manner, e.g., the use of peelable sealing strips like that disclosed in the aforementioned Goglio patents, whose disclosures are incorporated by reference herein.

When the package 22 is filled, vacuumized, and sealed its contents, e.g., whole bean coffee (not shown), will be kept isolated from the ambient air by the seal line 40. The closure 22 is also preferably closed, i.e., its strips 24A and 24B being interconnected, at this time although such action is not mandatory. If desired, the top portion 34 of the package may be folded down to form a flap (not shown). The flap may, if desired, be held in place by a strip of adhesive tape (not shown) or some other adhesive means, so that the package is "brick-like" in shape to facilitate stacking or storage.

In order to gain ingress into the package so that some or all of its contents can be removed, if the package has a peelable seal line 40, the portions of the front and rear panels of the package contiguous with the top marginal edges 38 of the package are grasped and pulled apart. This action peels open the seal line 40, while also disconnecting or separating the two strips (to be described later) making up the closure 22, to open the mouth of the package. The contents of the package can then be poured or otherwise removed through the package's mouth. If the package includes a non-openable seal line 40, e.g., a permanent heat seal, then the package can be severed below the heat seal line and above the closure 24. The newly formed top edge of the front and rear panels of the package which were formed by severing action can then be grasped and pulled apart to separate and disconnect the two strips 24A and 24B to open the mouth of the package.

The inclusion of the closure 22 as a part of the package (as in the embodiment of FIGS. 1–5) or the use of a separate closure 100 (as in the embodiment of FIG. 6) with a conventional package enable the mouth of the package to be re-closed or resealed after some of the package's contents have removed. Thus, the package and closure of the subject invention enable one to keep the remaining contents of the package fresh, i.e., generally isolated from the ambient atmosphere.

The closure 24, as mentioned above, comprises the pair of strips 24A and 24B which are arranged to releasably mate with each other. Each of the strips is an elongate member formed of a plastic material, e.g., high or low density polyethylene or polypropylene or some other material which is slightly flexible to enable it to be bent out of its original shape by the application of force thereto, but which returns to its original shape after removal of that force. Each strip is arranged to be fixedly secured, e.g., welded or permanently adhesively secured to the outer surface of the top portion of a respective one of the panels 26 and 28 of the package 22 and across the full width of the panel.

Figure 5:
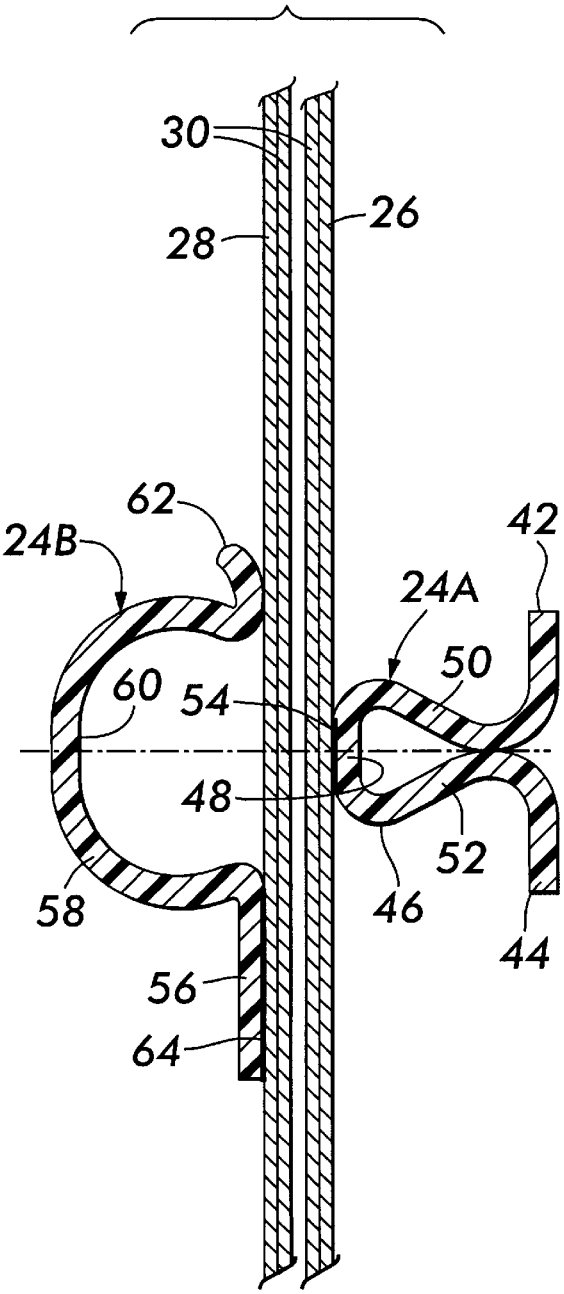
FIG. 5 is an enlarged sectional view like that of FIG. 4, but showing the package in the process of being resealed or re-closed using the package's closure.

The construction of the strip 24A can best be seen in FIGS. 3 and 5 and basically consists of an elongated tongue-shaped member. In particular, the strip 24A includes an elongated planar upper flange section 42, an elongated planar lower flange section 44 and an intermediate projecting tongue section 46. The tongue section includes a generally planar top wall 48 and a pair of undercut sidewalls 50 and 52 which merge with the upper and lower flanges 42 and 44, respectively. The planar wall 48 of the tongue shaped strip 24A is fixedly secured along to the outer surface of the front panel 26 via any suitable securement means 54 (FIG. 5), e.g., a hot melt adhesive, any other type of adhesive, a weld joint, etc.

The construction of the strip 24B can best be seen in FIGS. 2 and 5 and basically consists of an elongated channel or recess-shaped member. In particular, the strip 24B includes an elongated planar lower flange section 56 and a generally C-shaped upper section 58 defining a groove or recess 60 therein. The free edge of the upper section 56 is in the form of a curved lip 62, but could be in the form of a rounded bead. The lower flange section 56 is fixedly secured along to the outer surface of the rear panel 28 of the bag via any suitable securement means 64, e.g., a hot melt adhesive, any other type of adhesive, a weld joint, etc.

It must be pointed out at this juncture that the strips 24A and 24B can be mounted and secured to the rear panel 28 and front panel 26, respectively, instead of to panels the front panel 26 and rear panel 28, respectively, as in the embodiment shown in FIGS. 1–5. Thus, the embodiment of package 22 shown herein is merely exemplary.

The material forming the strips is somewhat elastic and/or flexible to enable the tongue 46 of the strip 24A to snap-fit into the groove or recess 60 of the strip 24B, and to be locked therein against accidental disconnection, yet which enable the tongue to exit that recess when the strips are pulled apart.

Once the package has been initially opened and a portion of its contents removed, the package can be readily resealed by use of the closure 24 to prevent or minimize the ingress of air into the interior of the package through its mouth. This action is accomplished by merely bringing the strips 24A and 22B into a confronting relationship, like shown in FIG. 5. Then the strips can be squeezed together to cause the tongue to snap into the groove carrying with it contiguous portions of the front panel 26 and side gussets 30 and 32. During this action portions of the front panel 26 and contiguous side gussets bend around the top surface 48 and undercut sidewalls 50 and 52 of the tongue 46 to be carried into engagement with opposed portions of the rear panel 28 and contiguous side gussets 30 and 32. These engaging panel and gusset portions are forced into the groove or recess 60. As will be appreciated by those skilled in the art since the groove strip 24B is secured to the rear panel 28 only along its lower flange section 56, the portion of the rear panel and contiguous gussets immediately above the securement point 64 can move or slide with respect to the free edge 62 of the strip 24B to be received in the groove 60 as shown in FIG. 4. Notwithstanding their slight elasticity/flexibility, the strips 24A and 24B are substantially rigid so that when they are snapped together as just described, the confronting portions of the tongue and groove serve to sandwich the front panel 26, rear panel 28, and side-gussets 30 and 32 tightly therebetween, thereby producing a substantially air-tight seal.

The fact that each of the strips includes flanged portions and other portions projecting from the flanged portions tends to reinforce the strips and keep them linear to further ensure that the mouth of the package is sealed closed when the strips are snap connected to each other. Thus, when the strips 24A and 24B are snapped together the contents of the bag 22 are effectively isolated from the ambient surroundings so that it can be kept fresh over an extended period of time.

The package can be readily opened at any time by merely snapping apart (disconnecting) the two strips 24A and 24B. In order to accomplish that action and since the strips are somewhat flexible and resilient, the user of the package can readily grasp any portion of the front panel of the package contiguous with its top edge between the thumb and forefinger of one hand, and grasp any portion of the rear panel of the package contiguous with its top edge between the thumb and forefinger of the other hand to pull the panels apart and to separate the strips. Alternatively, the user can directly grasp one of the strips between his/her thumb and forefinger of one hand and the other strip between the thumb and forefinger of the other hand to pull the strips apart. In either case this action unsnaps the closure, i.e., causes the tongue of strip 24A to snap out of the groove of strip 24B, thereby freeing the panels and providing access to the interior of the package through its mouth.

Figure 6:
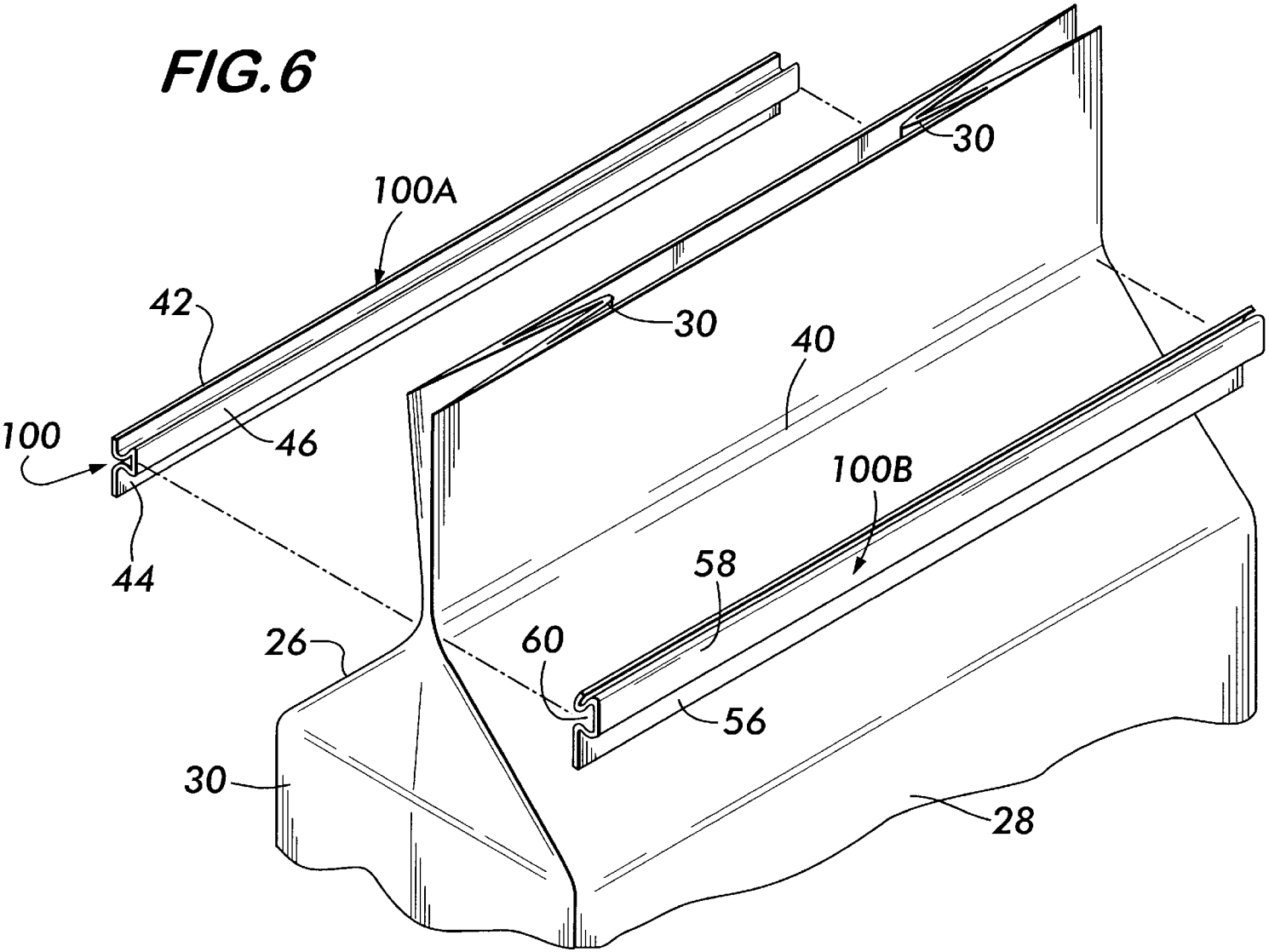
FIG. 6 is an isometric view of a separate closure constructed in accordance with this invention for use on a conventional flexible gusseted package, with only the top portion of the package being shown.

In FIG. 6 there is shown an alternative embodiment of this invention. In that embodiment the closure 100 is a separate device, i.e., is not an integral part of the gusseted flexible package, but is arranged to be mounted or releasably secured thereto after the package has been opened to reseal it. The closure 100 is constructed in an identical manner to the closure 20 described heretofore and can be used on any type of flexible package. In the embodiment shown in FIG. 6 the flexible package is designated by the reference number 102 and is a gusseted bag constructed like the bag 22 described heretofore except for the fact that it does not include an integral closure 24.

In the interests of brevity the common components of the gusseted bag 102 with that of the bag 22 will be given the same reference numbers and their construction and features will not be reiterated. The closure 100 includes a tongue strip 100A which is identical to strip 24A and a groove strip 100B which is identical to strip 24B. Thus, the same reference numbers will be given for the components making up the tongue strip 100A as were given to the strip 24A, and the same reference numbers will be given for the components making up the groove strip 100B as were given to the groove strip 24B. Moreover, the details and features of those strips will also not be reiterated. Suffice it to state that the closure 100 is arranged to be releasably secured to the gusseted flexible bag 102 to enable it to be resealed after it has been opened. To that end the tongue strip 100A is brought into engagement with the outer surface of either the front panel or rear panel of the bag 102. In the embodiment shown the tongue strip 100A is brought into engagement with the rear panel 28 of the bag 102. In a similar manner the groove strip 100B is brought into engagement with the outer surface of the front panel 26 of the bag 102 so that its groove 60 is aligned with the tongue 46 of the tongue strip 100A. The two strips 100A and 100B are then pressed together to cause the tongue of strip 100A to enter into the groove of strip 100B carrying with it the contiguous portions of the rear panel 28, front panel 26 and interposed side gussets 32 and 30 in the same manner as described above.

In FIGS. 7–10 there is shown another embodiment of a flexible gusseted package 200 constructed in accordance with this invention. The package 200 includes a gusseted bag 22 constructed in an identical manner to that of the package 20 described heretofore, and an alternative closure 202. Since the bag 22 of the package 200 is identical to the bag of the package 20, the same reference numbers will be used and details of the construction and features of the bag will not be reiterated in the interest of brevity.

The closure 202 comprises a tongue strip 202A and a groove strip 202B. The groove strip 202B of package 200 is very similar to the groove strip 24B except for the inclusion of an upper flange as the free end of the upper C-shaped section (as will be described later). The tongue strip 202A of the package 200 is also similar in construction to the tongue strip 24A, except that upper and lower flanges are initially curved or arcuate but are arranged to be flattened out when the two strips of the closure 202 are secured together to provide a visual indication of that fact (as will also be described later).

The construction of the strip 202A can best be seen in FIGS. 8 and 10. Thus, as can be seen therein the strip 202A is an elongated member which includes an elongated arcuate upper flange section 204, an upper hinge section 206, an elongated arcuate lower flange section 208, a lower hinge section 210, and a central projecting tongue section 212. The tongue section 212 is constructed like the tongue section 46 described heretofore and thus includes a generally planar top wall 48 and a pair of undercut sidewalls 50 and 52 which merge with the upper and lower hinge sections 206 and 210, respectively. As can be seen clearly in FIG. 10 each hinge section 206 and 210 is generally semicircular in cross section. The planar wall 48 of the tongue shaped strip 202A is fixedly secured along to the outer surface of the front panel 26 in the same manner as described earlier.

The construction of the strip 202B is also an elongated member which is best seen in FIGS. 8 and 10 and is an elongated channel or recess-shaped member. In particular, the strip 202B includes an elongated planar lower flange section 56 and a generally C-shaped upper section 58 defining a groove or recess 60 therein. The free edge of the upper section 56 is in the form of a planar upper flange 214 terminating in a curved lip 216. The lip may be in the form of a rounded bead. The lower flange section 56 is fixedly secured along to the outer surface of the rear panel 28 in the same manner as described earlier, e.g., by means of a hot melt adhesive 64, any other type of adhesive, a weld joint, etc.

The strips 202A and 202B can be mounted and secured to the rear panel 28 and front panel 26, respectively, instead of to the front panel 26 and rear panel 28, respectively, as in the embodiment shown in FIGS. 7–10. Thus, the embodiment of package 200 shown herein is merely exemplary.

The material forming the strips is somewhat elastic and/or flexible to enable the tongue 212 of the strip 202A to snap-fit into the groove or recess 60 of the strip 202B, and to be locked therein against accidental disconnection, yet which enable the tongue to exit that recess when the strips are pulled apart.

Once the package 200 has been initially opened and a portion of its contents removed, the package can be readily resealed by use of the closure 202 to prevent or minimize the ingress of air into the interior of the package through its mouth. This action is accomplished by merely bringing the strips 202A and 202B into a confronting relationship, like shown in FIG. 10. Then the strips can be squeezed together to cause the tongue to snap into the groove carrying with it contiguous portions of the front panel 26 and side gussets 30 and 32. During this action the hinge sections flatten out, i.e., pivot outward, so that the upper and lower flange portions 206 and 208, respectively, assume a planar configuration to abut the outer surface of the contiguous portions of the front panel 26. At the same time portions of the front panel 26 and contiguous side gussets bend around the top surface 48 and undercut sidewalls 50 and 52 of the tongue 46 of the strip 202A to be carried into engagement with opposed portions of the rear panel 28 and side gussets 30 and 32. These engaging panel and gusset portions are forced into the groove or recess 60 in the strip 202B. As will be appreciated by those skilled in the art since the groove strip 202B is secured to the rear panel 28 only along its lower flange section 56, the portion of the rear panel and contiguous gussets immediately above the securement point 64 can move or slide with respect to the upper flange 214 and its curved free edge 216 of the strip 202B to be received in the groove 60 as shown in FIG. 9. When the tongue 212 is fully within the groove the upper and lower flanges 204 and 208 will be planar as shown in FIG. 9. Notwithstanding their slight elasticity/flexibility, the strips 202A and 202B are substantially rigid so that when they are snapped together as just described, the confronting portions of the tongue and groove serve to sandwich the front panel 26, rear panel 28, and side-gussets 30 and 32 tightly therebetween, thereby producing a substantially air-tight seal. The upstanding and now planar upper flange 204 of the tongue strip 202A and the confronting upstanding flange 216 of the groove strip 202B sandwich portions of the top portion 34 of the bag 22 between them and thus ensure that the top portion 34 of the bag 22 extends upward generally parallel to the front and rear panels of the package. If desired, the groove strip 202B may be constructed to that the upper C-shaped section is constructed like the C-shaped section of the groove strip 24B. In such an embodiment the top portion 34 of the bag 22 may not be oriented so that it is parallel to the front and rear panels of the bag when the closure is in place since the upper flange 204 of the tongue strip 202A will tend to assume its natural arcuate shape, thus bending the top portion of the bag 22 away from it.

The fact that each of the strips includes flanged portions and other portions projecting from the flanged portions tends to reinforce the strips and keep them linear to further ensure that the mouth of the package is sealed closed when the strips are snap connected to each other. Thus, when the strips 202A and 202B are snapped together the contents of the bag 22 are effectively isolated from the ambient surroundings so that it can be kept fresh over an extended period of time.

As will be appreciated by those skilled in the art, when the package 200 has been effectively resealed by use of its closure 202, i.e., the tongue of the strip 202A is fully seated within the groove 60 of the strip 202B so that an air-tight seal is produced, this fact will be readily apparent to anyone seeing the package since the flanges 204 and 208 of the tongue strip 202A will have assumed a planar configuration. Accordingly, the package 200 provides a visual indication of a good, air-tight reseal.

The package 200, like the package 20, can be readily opened at any time by merely snapping apart (disconnecting) the two strips 202A and 202B in the same manner as described earlier.

It must be pointed out at this juncture that a separate closure constructed like the closure 202 can be made in accordance with this invention for releasable securement to any flexible package in the same manner that the closure 100 can be utilized with any type of flexible package. Thus, the closure 202 need not be made as an integral component of a flexible package.

Figure 11:
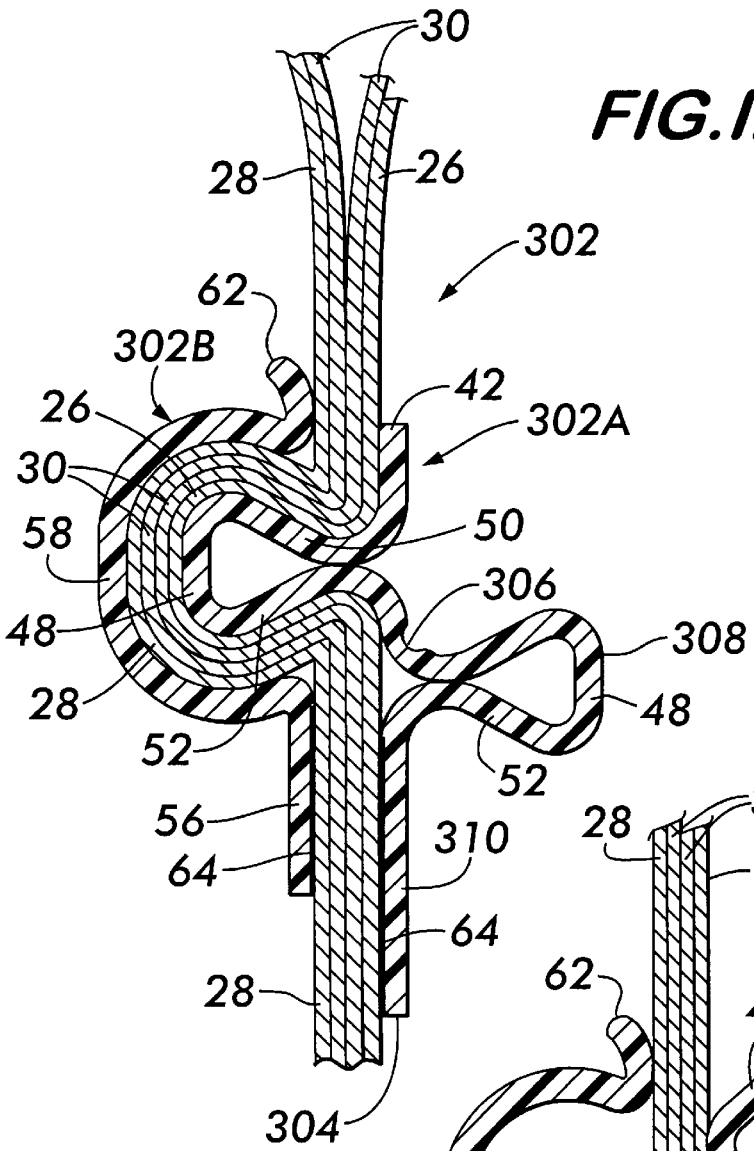
FIG. 11 is a sectional view, like that of FIG. 4, but showing another embodiment of a flexible gusseted package including a closure constructed in accordance with this invention and being shown in the state prior to being initially opened.
Figure 12:
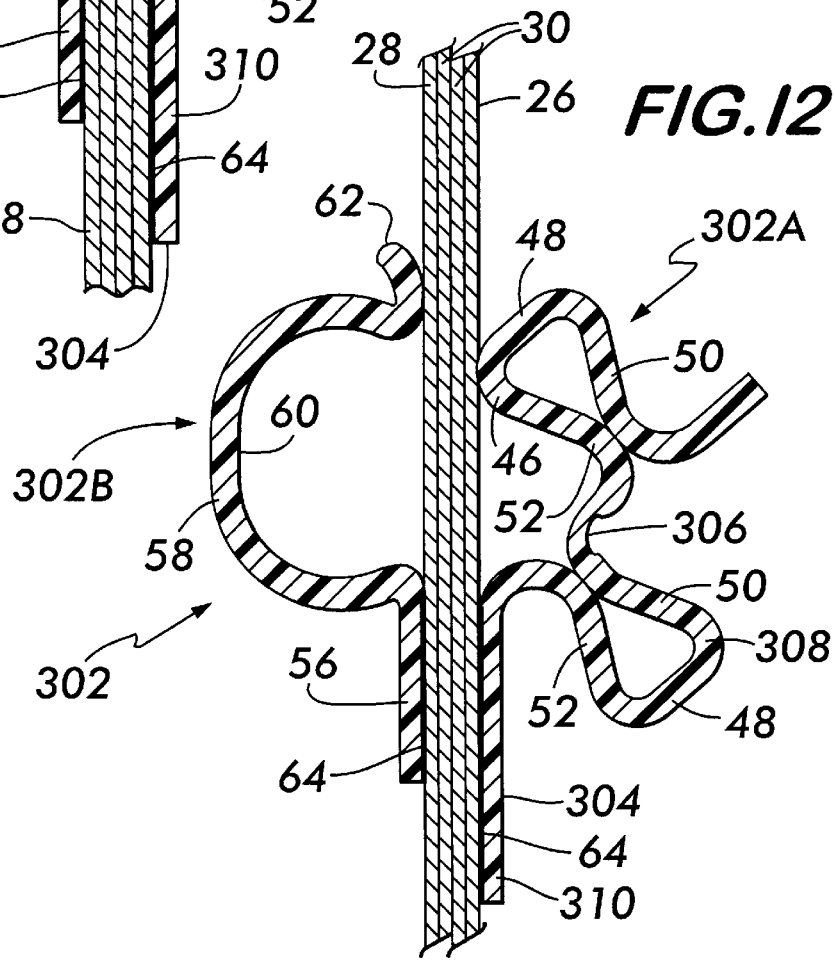
FIG. 12 is a sectional view, like that of FIG. 5, but showing the embodiment of the package of FIG. 11 in the process of being resealed or re-closed using the package's closure.

In FIGS. 11 and 12 there is shown another embodiment of a flexible gusseted package 300 constructed in accordance with this invention and utilizing an alternative closure 302 fixedly secured to a gusseted bag 22. The closure 302 includes a tongue strip 302A and a groove strip 302B. The tongue strip 302A is constructed similarly to strip 24A, except for the inclusion of additional means to enable it to be more securely affixed to its associated bag panel so it cannot accidentally become disconnected. The groove strip 302B is constructed identically to the groove strip 24B of closure 24. Similarly, the gusseted bag 22 is constructed in an identical manner to that of the package 20 described heretofore. Since the bag 22 and the groove strip 202B of the package 300 are identical to the bag 22 and groove strip 24B of the package 20, the same reference numbers will be used and details of the construction and features of those components will not be reiterated in the interest of brevity. The tongue strip 302A is an elongated, integral member which includes all of the features of the tongue strip 24A, except that the lower flange section 44 has been replaced by an alternative lower flange section 304 for use in mounting the strip onto its associated panel instead of using the outer surface of the planar top wall 48 (as is the case with the tongue strip 24A described earlier).

The lower flange section 304 basically comprising a living hinge 306 of reduced wall thickness to enable it to bend freely, an inverted projecting tongue portion 308, and a mounting flange 310. The inverted tongue portion 308 is of the same shape as the portion 46 of the strip 302A, i.e., includes a generally planar wall 48 and a pair of undercut sidewalls 50 and 52 which merge with the upper and lower flanges 42 and 310, respectively, except that it faces in the opposite direction therefrom. The lower mounting flange 310 is used to fixedly secure the tongue strip 302A to the panel 26 of the bag 22 via either an adhesive 64 or by being welded or otherwise bonded to the panel. Since the lower mounting flange serves as the means for mounting the strip onto the panel the flange 310 is somewhat similar to the flange 44 of the strip 24A, except that it is of greater height to provide greater contact area for the adhesive or the weldment. When the strip 302A is fixedly secured to the panel 26 and when the closure 300 is open, i.e., the tongue strip is not interlocked to the groove strip, the strip is in the orientation as shown in FIG. 12. In particular, the interface of the flat top 48 and the undercut sidewall 52 of the tongue section 46 of the strip 302A abuts the outer surface of the panel 26. In order to close the package, i.e., cause the two closure strips to interlock, all that is required is to press on the tongue strip to bend and pivot it inward and thereby force the tongue section 46 to enter into the recess 60 in the groove strip 302B to thereby tightly interpose the bag walls therebetween as described earlier. The living hinge 306 facilitates the bending and pivoting of the tongue section from the orientation shown in FIG. 12 to the orientation shown in FIG. 11. The material forming the strips is somewhat elastic and/or flexible to enable the tongue 46 of the strip 302A to snap-fit into the groove or recess 60 of the strip 302B, and to be locked therein against accidental disconnection, yet which enable the tongue to exit that recess when the strips are pulled apart.

It must be pointed out at this juncture that the strips 302A and 302B can be mounted and secured to the rear panel 28 and front panel 26, respectively, instead of to panels the front panel 26 and rear panel 28, respectively, as in the embodiment shown in FIGS. 1–5. Thus, the embodiment of package 22 shown herein is merely exemplary.

The package can be readily opened at any time by merely snapping apart (disconnecting) the two strips 302A and 302B of the closure 302. In order to accomplish that action and since the strips are somewhat flexible and resilient, the user of the package can readily grasp any portion of the front panel of the package contiguous with its top edge between the thumb and forefinger of one hand, and grasp any portion of the rear panel of the package contiguous with its top edge between the thumb and forefinger of the other hand to pull the panels apart and to separate the strips. Alternatively, the user can directly grasp to upper edge portion 62 of the groove strip 302B between his/her thumb and forefinger of one hand and the upper edge portion 42 the tongue strip 302A between the thumb and forefinger of the other hand to pull the strips apart. In either case this action unsnaps the closure, i.e., causes the tongue of strip 302A to snap out of the groove of strip 302B, thereby freeing the panels and providing access to the interior of the package through its mouth.

Figure 13:
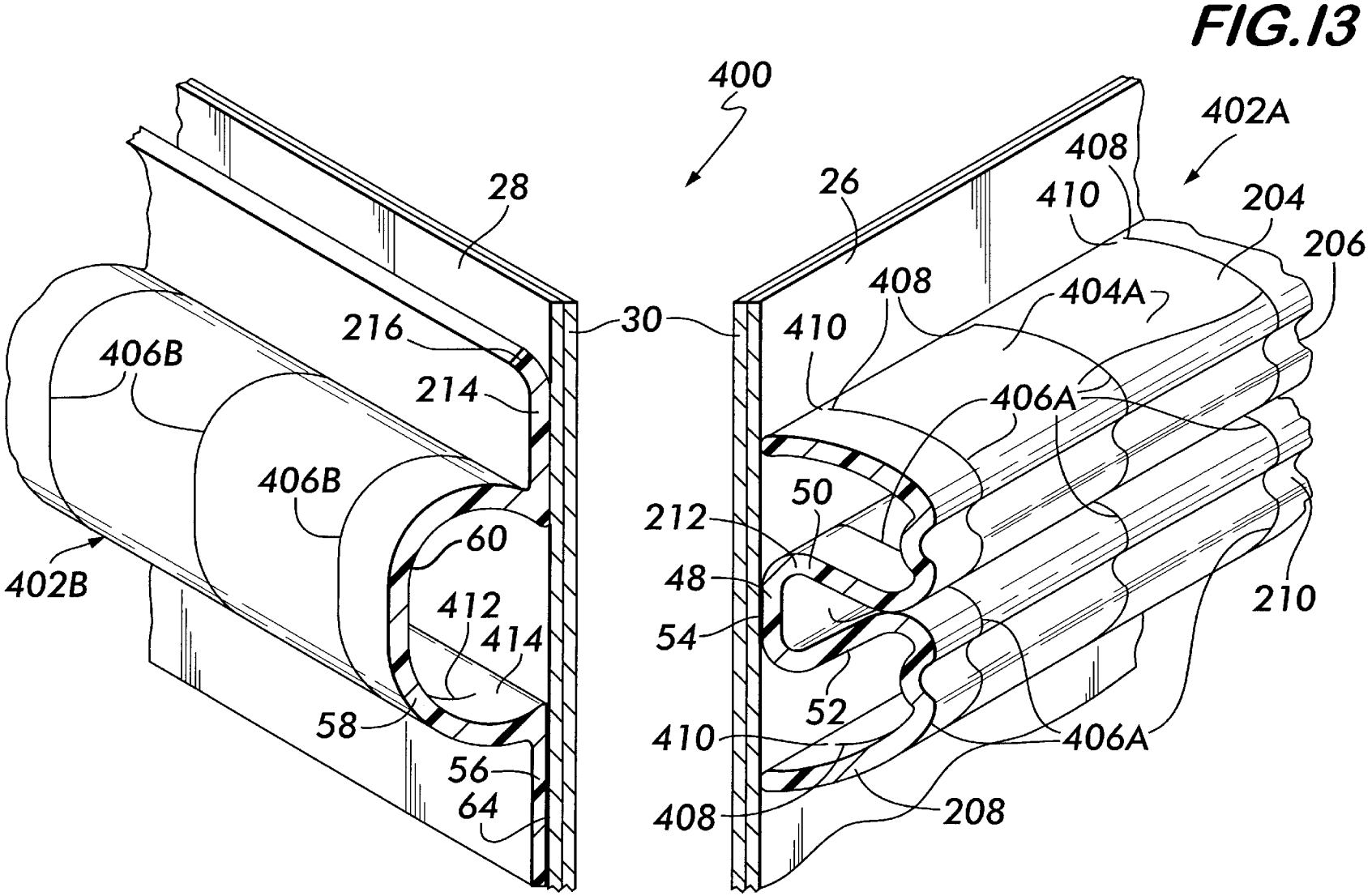
FIG. 13 is an exploded isometric view of still another embodiment of a flexible gusseted package including a closure constructed in accordance with this invention.
Figure 14:
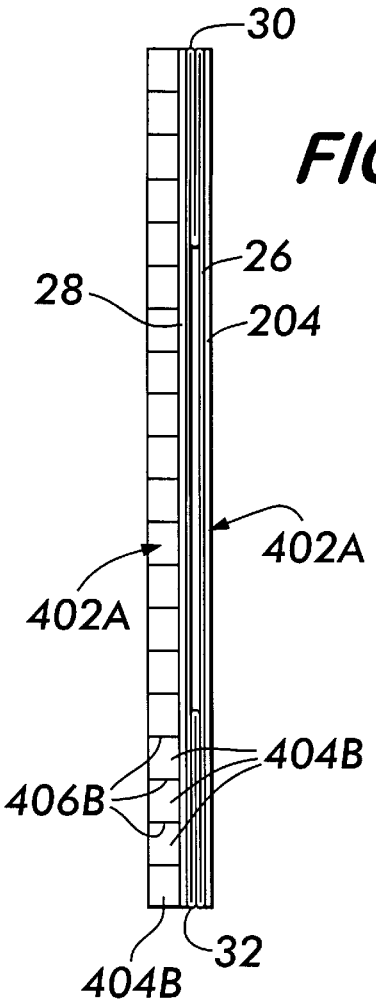
FIG. 14 is a reduced top plan view of the package shown in FIG. 13, shown in its sealed configuration.

In FIGS. 13–14 there is shown another embodiment of a flexible gusseted package 400 constructed in accordance with this invention. The package 400 includes a gusseted bag constructed in an identical manner to that of the package 20 described heretofore, and an alternative closure 402. Since the bag of the package 400 is identical to the bag of the package 20, the same reference numbers will be used hereinafter and details of the construction and features of the bag will not be reiterated in the interest of brevity.

The closure 402 is identical to the closure 202 described heretofore, except that each of the closure's tongue strip 402A and the groove strip 402B are segmented. By segmented it is meant that each strip 402A and 402B comprises a plurality of segment sections (to be described later) which are disposed along the length (i.e., the longitudinal axis) of the strip and are separated from one another by interposed slits or other means enabling the various segment sections to bend with respect to each other in the longitudinal direction. Since the details of the strips 404A and 404B of the closure 400 are identical to the strips 202A and 202B, respectively, of the closure 202 except for the use of the segmented sections, and in the interest of brevity the common details of the construction of the closure 402 to closure 202 will be given the same reference characters and their description will not be reiterated.

The construction of the strips 402A and 402B can best be seen in FIG. 13. In particular, the tongue strip 402A is an elongated member which includes an elongated arcuate upper flange section 204, an upper hinge section 206, an elongated arcuate lower flange section 208, a lower hinge section 210, and a central projecting tongue section 212. The strips 402A is segmented to form a plurality of short length segment sections 404A, each of which is separated from its immediately adjacent section by a slit 406A. Each slit 406A extends partially through the tongue strip 402A in a plane which is perpendicular to the longitudinal axis of the strip 402A. To that end each slit 406 extends fully through the tongue section 212, fully through the adjacent hinge sections 206 and 210, but only partially through the arcuate upper flange section 204 and partially through the arcuate lower flange section 208, to a terminus point 408 immediately adjacent the edges of those sections. The material making up the strip 402A between the edge of the flange 204 and the terminus points 408 forms a plurality of flexure joints 410 thereat. In a similar manner, the material making up the strip 402A between the edge of the flange 208 and the terminus points 408 form a plurality flexure joints 410 thereat. The flexure joints 410 enable the segment sections 404A of the closure strip 402A to flex or bend with respect to the longitudinal axis about them. In accordance with one preferred embodiment of this invention the slits 406A of the strip 402A are equidistantly spaced, from one another.

The strip groove 402B is an elongated channel or recess-shaped member. In particular, as best seen in FIG. 13, the strip 402B includes an elongated planar lower flange section 56 and a generally C-shaped upper section 58 defining a groove or recess 60 therein. The C-shaped upper section 58 is segmented to form a plurality of short length segment sections 404B, each of which is separated from its immediately adjacent section by a slit 406B. Each slit 406B extends partially through the C-shaped upper section in a plane which is perpendicular to the longitudinal axis of the strip 402B. Each slit terminates at one end in a terminus point 412 closely adjacent the flange 214. The other end of each slit terminates in a terminus point 412 closely adjacent the flange 56. The slits 406B do not, however, extend into the flanges 56 or 214. Thus, each slit terminates in a pair of terminus points 408, one closely adjacent the flange 56 and the other closely adjacent the flange 214. The material making up the strip 402B between the flange 56 and the terminus points 408 forms plural flexure joints 414 thereat. In a similar manner, the material making up the strip 402A between the flange 214 and the terminus point 408 forms a plurality of flexure joints 414 thereat. The flexure joints 414 of the strip 402B enable the segment sections 404B to flex or bend with respect to the longitudinal axis about them. In accordance with one preferred embodiment of this invention the slits 406 of the closure strip 402B are also equidistantly spaced, from one another.

The strips 202A and 202B are mounted and secured to the front panel 26 and rear panel 28, respectively, or to the rear panel 28 and front panel 26, respectively, depending upon the desires of the manufacturer. Thus, it should be borne in mind that the embodiment of package 400 shown herein is merely exemplary. Moreover, the strips 202A and 202B may be separate components from the package, i.e., be arranged to be mounted on the package when their use is desired and removed from the package when their use is not desired. In either case, the plural flexure joints 210 separating the segment sections of the strips, permit the strips to bend to facilitate the opening of the package on which they are disposed. In this regard, as will be appreciated when the package 400 is initially sealed shut by the peelable seal 40 (not shown in FIGS. 13–14), the closure 400 will be in its closed state, i.e., the tongue of strip 404B will be snap-fit within the recess 60 in the strip 404A with the continuous portions of the package's panels interposed tightly therebetween in the same manner as described earlier and as shown in the top view of FIG. 14.

Figure 15:
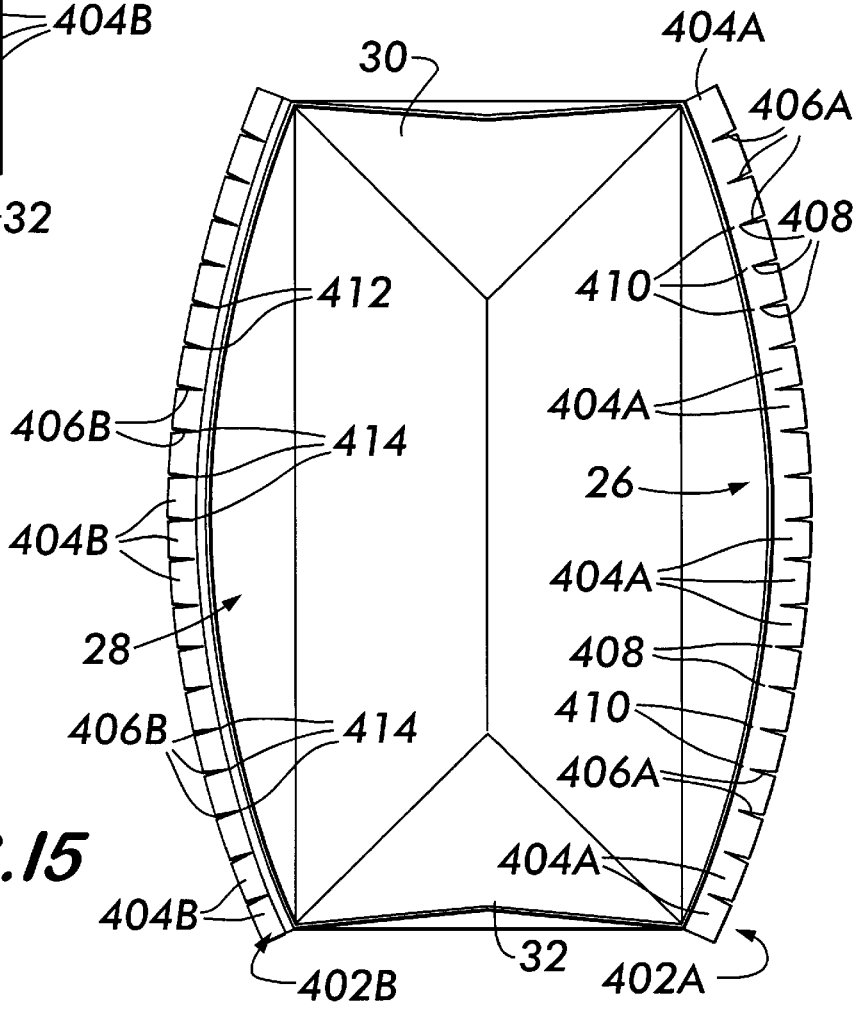
FIG. 15 is top plan view, similar to FIG. 14, but showing the package of FIG. 13 in its open or unsealed configuration.

In order to open the package the user merely grasps the two closure strips 202A and 202B between the thumb and index finger of each hand to and pulls outward on each. This action has the effect of causing tongue portion 212 of the strip 402A to snap out of the groove 60 in strip 402B. The outward pulling on the two strips also causes the segment sections of those strips to flex about their interposed flexure joints, whereupon the strips 402A and 402B bow outward. The bowing outward of the closure strips such as shown in FIG. 15 causes the peelable seal 40 to open up, thereby opening the mouth of the package so that its contents can be removed through the open mouth.

Once the package 400 has been initially opened and a portion of its contents removed, the package can be readily resealed by use of the closure 402 to prevent or minimize the ingress of air into the interior of the package through its mouth. This action is accomplished by merely bringing the strips 402A and 402B into a confronting relationship. Then the strips can be squeezed together to cause the tongue 212 of strip 402A to snap into the groove 60 of strip 402B carrying with it contiguous portions of the front panel 26 and side gussets 30 and 32. During this action the hinge sections 206 and 210 of the strip 402A flatten out, i.e., pivot outward, so that the upper and lower flange portions 206 and 208, respectively, of that strip assume a planar configuration to abut the surface of the contiguous portions of the front panel 26. At the same time portions of the front panel 26 and contiguous side gussets bend around the top surface 48 and undercut sidewalls 50 and 52 of the tongue 46 of the strip 402A to be carried into engagement with opposed portions of the rear panel 28 and side gussets 30 and 32. These engaging panel and gusset portions are forced into the groove or recess 60 in the strip 402B.

Notwithstanding their flexibility in the longitudinal direction resulting from the flexure joints between the segment sections, the strips 402A and 402B are sufficiently rigid so that when they are snapped together as just described, the confronting portions of the tongue and groove serve to sandwich the front panel 26, rear panel 28, and side-gussets 30 and 32 tightly therebetween, thereby producing a substantially air-tight seal. The upstanding and now planar upper flange 204 of the tongue strip 402A and the confronting upstanding flange 214 of the groove strip 402B sandwich portions of the top portion 34 of the bag 22 between them and thus ensure that the top portion 34 of the bag extends upward generally parallel to the front and rear panels of the package.

It should also be pointed out that packages constructed in accordance with this invention which have the tongue strip and the groove strip fixedly secured thereto may utilize any type of securement means to fixedly secure them in place on their respective panels. Thus, for example, an adhesive coating or coextrusion may be utilized to secure each strip in place on its associated panel. Alternatively, the material forming the strips or only a portion of the strips may be selected so that it can be heat sealed or welded to the material making up the bag's panels.

It should also be pointed out that the closures of this invention can be used on various types of flexible packages other than those specifically shown herein, e.g., packages which do not include side gussets, such as pouches. Moreover, the closures may form a portion of such packages, i.e., be fixedly secured thereto, or may be separate devices for releasable securement to such packages.

In order to facilitate the opening and closing of any of the closures of this invention, whether the closure is part of the package or merely a device to be releasably mounted thereon, either or both of the strips making up the closure may include some surface texture, e.g., ridges, knurls, grooves, etc., to enhance friction when grasped between the fingers of the user of the package.

Closures and packages including closures constructed in accordance with this invention offer several advantages over pouch-type packages including conventional zip-lock type or other internally-located closures. For example, the closure may be applied to the pouch, after the pouch has been filled and sealed. Moreover, the closure provides rigid support to maintain the package's shape and integrity. The closures of this invention, being externally located or applied, do not render the package on which they are used subject to contamination and, hence, ineffective, as is a common occurrence with internally applied closures, such as a zip-lock type closures. Further still, zip-lock type closures and other internally located heat sealable closures are limited in the types of material from which they can be formed or fabricated, e.g., they must be made of a material which is compatible with the sealant layer of the pouch. The closures of this invention, being located externally, can be formed of any number of materials chosen to meet the requirements of the particular application.

As will also be appreciated by those skilled in the art, the closures of this invention can be modified insofar as its construction and/or material composition is concerned in order to accommodate the preferred degree of opening and/or closing pressure required to operate it.

Without further elaboration the foregoing will so fully illustrate our invention that others may, by applying current or future knowledge, adopt the same for use under various conditions of service.

I claim:

1. In combination a package having an interior for holding material therein and a snap-closure therefor, said package being formed of a flexible material and comprising first and second panels connected to each other, each of said panels having an outside surface, an inside surface and an upper end portion whose inside surfaces conjoin to form a mouth for said package, said mouth being openable to provide access to the interior of the package, said snap closure being arranged for reclosing and sealing said mouth and comprising a first closure element and second closure element, said first closure element being located on said outside surface of said first panel adjacent said mouth, said second closure element being located on said outside surface of said second panel adjacent said mouth, said first element being an elongated, segmented member having a longitudinal axis extending substantially the width of said first panel and a having a tongue extending substantially the width thereof, said second element being an elongated, segmented member having a longitudinal axis extending substantially the width of said second panel and parallel to said longitudinal axis of said first element, said second element having an undercut groove extending substantially the width thereof, said tongue of said first closure element being arranged to be snap-fit into said undercut groove of said second closure element with portions of said panels tightly interposed therebetween to close the mouth of package to prevent the ingress of air into the package through said mouth, said first closure element having a plurality of narrow slits spaced apart from one another extending outward transversely to said longitudinal axis of said first closure element, said second closure element having a plurality of narrow slits spaced apart from one another extending outward transversely to said longitudinal axis of said second closure element, said slits in said closure elements being arranged to enable said closure elements to be bowed outward with respect to each other to facilitate the opening of said mouth of said package after said mouth has been closed by said closure.

2. The package of claim 1 wherein each of said closure elements comprises a large plurality of short segment sections, each of said segment sections being formed between immediately adjacent slits of each of said closure elements.

3. The package of claim 2 wherein said slits of said first closure element extend perpendicularly to said longitudinal axe of said first closure element, and wherein said slits of said second closure element extend perpendicularly to said longitudinal axis of said second closure element.

4. The package of claim 3 wherein said slits are equidistantly spaced from each other.

5. The package of claim 1 wherein said first and second closure elements are fixedly secured to said first and second panels, respectively.

6. The package of claim 5 wherein each of said closure elements comprises a large plurality of short segment sections, each of said segment sections being flexibly connected to an adjacent segment sections to enable each closure element to flex with respect to its longitudinal axis to enable the user of the package to readily insert his/her fingers between said two closure elements to pull them apart to open said mouth of said package.

7. The package of claim 6 wherein said segment sections are formed by a plurality of slits extending perpendicularly to said longitudinal axes.

8. The package of claim 7 wherein said slits are equidistantly spaced from each other.

9. The package of claim 1 wherein said first and second closure elements are separate from said package but arranged to be releasably disposed on said first and second panels, respectively, when desired to reseal said mouth.

10. The package of claim 9 wherein each of said closure elements comprises a large plurality of short segment sections, each of said segment sections being formed between immediately adjacent slits of each of said closure elements.

11. The package of claim 10 wherein said slits of said first closure element extend perpendicularly to said longitudinal axe of said first closure element, and wherein said slits of said second closure element extend perpendicularly to said longitudinal axis of said second closure element.

12. The package of claim 11 wherein said slits are equidistantly spaced from each other.

13. The package of claim 1 wherein said first and second closure elements each are formed of a plastic material.

14. The package of claim 1 wherein said package is formed of a material enabling the contents of said package to be maintained under vacuum when said package is sealed.

15. The package of claim 14 wherein said package includes a seal at said mouth for sealing said package to maintain the contents of said package under vacuum.

16. The package of claim 15 wherein said seal is peelable.

17. The package of claim 1 wherein one of said closure elements includes a first portion and a second portion, said first portion of said one of said closure elements being arranged to move with respect to said second portion of said one of said closure elements when said tongue of said first closure element is snap-fit into said undercut groove of said second closure element to thereby provide a visual indication that said tongue is fully within said undercut groove.

18. The package of claim 17 wherein said first portion of said one of said closure elements comprises an arcuate flanged portion which is arranged to become planar when said tongue is fully within said groove.

* * * * *